US010389028B2

(12) United States Patent
Liu

(10) Patent No.: US 10,389,028 B2
(45) Date of Patent: Aug. 20, 2019

(54) ANTENNA AND WEARABLE DEVICE

(71) Applicant: AAC Technologies Pte. Ltd., Singapore (SG)

(72) Inventor: Jianchuan Liu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/869,188

(22) Filed: Jan. 12, 2018

(65) Prior Publication Data

US 2018/0358704 A1 Dec. 13, 2018

(30) Foreign Application Priority Data

Jun. 8, 2017 (CN) ..... 2017 1 0425547

(51) Int. Cl.
*H01Q 9/04* (2006.01)
*H01Q 1/27* (2006.01)

(52) U.S. Cl.
CPC ..... *H01Q 9/0464* (2013.01); *H01Q 1/273* (2013.01); *H01Q 9/0428* (2013.01); *H01Q 9/0457* (2013.01)

(58) Field of Classification Search
CPC .... H01Q 9/0464; H01Q 9/0428; H01Q 9/045; H01Q 9/0457
See application file for complete search history.

(56) References Cited

U.S. PATENT DOCUMENTS

2017/0179581 A1* 6/2017 Puuri ..... H01Q 1/273

* cited by examiner

*Primary Examiner* — Robert Karacsony
(74) *Attorney, Agent, or Firm* — Na Xu; IPro, PLLC

(57) ABSTRACT

An antenna, including: a circuit board including a first grounding point, a second grounding point and a feeding point; a metal ring suspended with respect to the circuit board; a grounding arm; and a feeding short-circuit arm; the metal ring, the grounding arm and the feeding short-circuit arm are spaced from each other, and the grounding arm is between the metal ring and the feeding short-circuit arm; the first grounding point is connected with the grounding arm, the second grounding point and the feeding point are both connected with the feeding short-circuit arm; every two of the metal ring, the grounding arm and the feeding short-circuit arm are coupled with each other to form a ring current on the metal ring, so as to achieve circular polarization properties. The structure and arrangement of the antenna are flexible, so as to be adapted to devices with small internal space.

8 Claims, 5 Drawing Sheets

ANTENNA AND WEARABLE DEVICE

TECHNICAL FIELD

The present disclosure relates to the field of communication technologies and, in particular, to an antenna and a wearable device.

BACKGROUND

Polarization loss is a factor which significantly influences the ability of receiving and transmitting signals of a system. Common satellite navigation systems such as global positioning system (Global Positioning System, GPS), global navigation satellite system, (Global Navigation Satellite System, GLONASS) and Beidou navigation system generally adopt a right-handed circular polarization (Right-Handed Circular Polarization, RHCP) antenna as a transmitting antenna. In a navigation system, if an electronic device serving as a receiver adopts an RHCP antenna as a receiving antenna, then the influence caused by polarization loss will be eliminated, the receiving performance will be improved remarkably. Conventional circular polarization antennas, for example ceramic patch antenna and helical antenna, have a large volume. As a result, it is difficult to embed them into the interior of a small electronic device. Therefore, the electronic devices (e.g., cellphone, wearable device etc.) in the market generally adopt linear polarization antennas. In view of the above, the ability of an electronic device on receiving satellite navigation signals is weakened.

REFERENCE SIGNS

Figure 1:
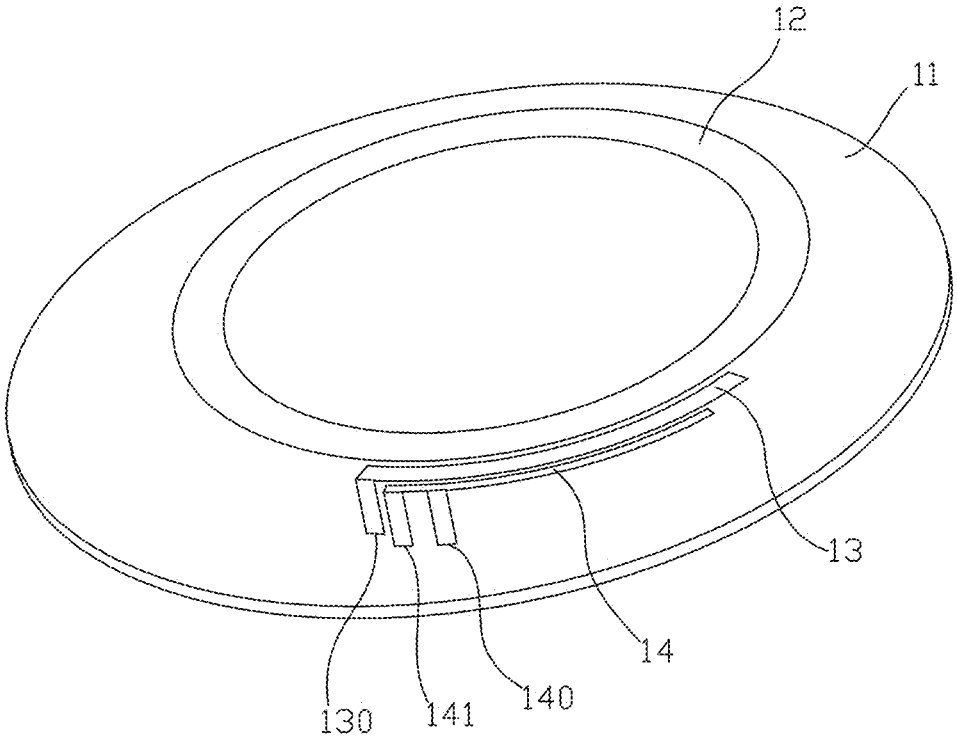
FIG. 1 is a structural schematic view of an antenna in accordance with an exemplary embodiment of the present disclosure.

11—circuit board;
12—metal ring;
13—grounding arm;
130—first grounding point;
14—feeding short-circuit arm;
140—second grounding point;
141—feeding point.

The drawings are incorporated into the specification and constitute as a part of the specification, which show embodiments of the present disclosure, and are used to explain the principle of the present disclosure together with the specification.

DESCRIPTION OF EMBODIMENTS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

The present disclosure will be described in further detail with reference to embodiments and accompany drawings.

Figure 2:
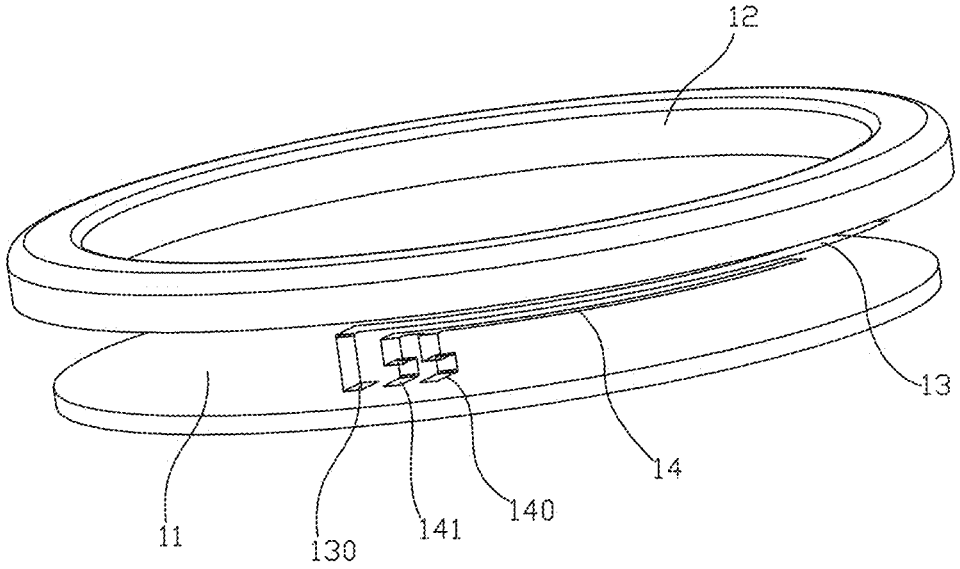
FIG. 2 is a structural schematic view of an antenna in accordance with an exemplary embodiment of the present disclosure.
Figure 3:
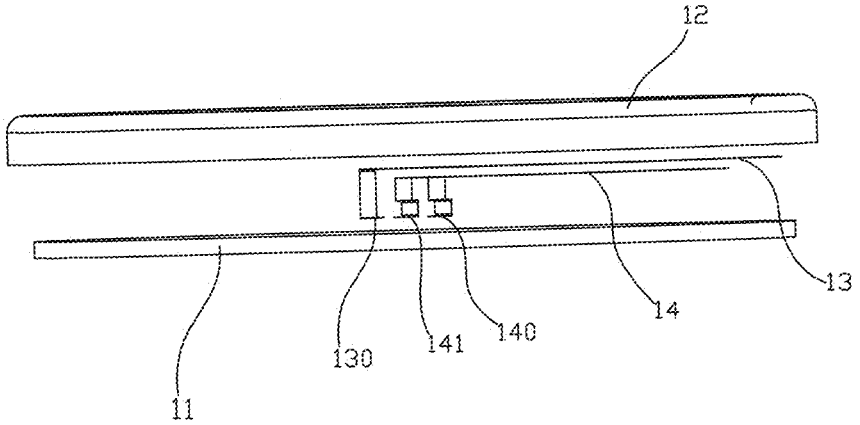
FIG. 3 is an exploded view of the antenna shown in FIG. 2.

As shown in FIGS. 1-3, an exemplary embodiment of the present disclosure provides an antenna, including a circuit board 11 which serves as an antenna ground, a metal ring 12, a grounding arm 13 and a feeding short-circuit arm 14. The metal ring 12 is suspended with respect to the circuit board 11. The metal ring 12, the grounding arm 13 and the feeding short-circuit arm 14 are spaced from each other, and the grounding arm 13 is between the metal ring 12 and the feeding short-circuit arm 14. The circuit board 11 has a first grounding point 130, a second grounding point 140 and a feeding point 141. The first grounding point 130 is connected with the grounding arm 13, and both the second grounding point 140 and the feeding point 141 are connected with the feeding short-circuit arm 14. Every two of the metal ring 12, the grounding arm 13 and the feeding short-circuit arm 14 are coupled with each other, so as to form a ring current on the metal ring 12, thereby achieving circular polarization properties of the antenna.

The metal ring 12 is a head-tail closed structure made of metal material, the shape of the metal ring 12 can be determined according to appearance of the electronic device to which the antenna is applied. For example, when the antenna is applied to a watch, since the dial plate of the watch can be designed as square, circular, oval etc., therefore, the metal ring 12 can also be designed as square, circular, oval etc., so as to guarantee appearance of the electronic device. The metal ring 12 can be suspended with respect to the circuit board 11 and is not directly connected with the circuit board 11. The structure and arrangement of the metal ring 12, the grounding arm 13 and the feeding short-circuit arm 14 in the antenna are relatively flexible, which can be designed according to specific structure of the device adopting the antenna, so that the antenna can be adapted to devices with small internal space.

In an exemplary embodiment, as shown in FIG. 1, the metal ring 12, the grounding arm 13 and the feeding short-circuit arm 14 are arranged in a plane parallel to the circuit board 11. That is to say, each of the metal ring 12, the grounding arm 13 and the feeding short-circuit arm 14 can be structured as a flat plate. Moreover, the metal ring 12, the grounding arm 13 and the feeding short-circuit arm 14 can be in a same plane.

In another exemplary embodiment, as shown in FIG. 2 and FIG. 3, the metal ring 12, the grounding arm 13 and the feeding short-circuit arm 14 are successively arranged in a direction from the metal ring 12 toward the circuit board 11. That is to say, a distance between the metal ring 12 and the circuit board 11, a distance between the grounding arm 13 and the circuit board 11, and a distance between the feeding short-circuit arm 14 and the circuit board 11 are different from each other. The distance refers to a distance in normal direction of the circuit board 11. Under the condition that such a structure can meet the requirements on antenna performance, the space between the circuit board 11 and the metal ring 12 can be utilized more sufficiently, so as to provide more design space for other components in the electronic device, thereby improving design flexibility of the entire antenna structure.

It should be noted that, the above two embodiments can be flexibly selected according to specific application scenario of the antenna, performance requirements of the antenna, cost requirements and the like, which will not be limited in the present disclosure.

As mentioned above, the metal ring 12 can be a circular ring. When the metal ring 12 is a circular ring, the grounding arm 13 and the feeding short-circuit arm 14 are both circular arc arms. At this time, centers of circles in which the metal ring 12, the grounding arm 13 and the feeding short-circuit arm 14 are respectively located can be located at a same normal line of the circuit board. At this time, the metal ring 12, the grounding arm 13 and the feeding short-circuit arm 14 can either be in a same plane, or can be successively arranged in a direction toward the circuit board 11 and spaced from each other.

When the centers of circles in which the metal ring 12, the grounding arm 13 and the feeding short-circuit arm 14 are respectively located are located at a same normal line of the circuit board 11, the distance between any two of the three centers can be selected, and corresponding antenna performance is detected and analyzed, which are shown as follows: a distance between the grounding arm 13 and the feeding short-circuit arm 14 in a radial direction of the metal ring 12 is 0.4 mm-0.8 mm, a distance between the grounding arm 13 and the metal ring 12 in the radial direction of the metal ring 12 is 0.6 mm-1.2 mm. When adopting such an arrangement, the antenna performance is better.

When a circumferential length of the grounding arm 13 is greater than or equal to a circumferential length of the feeding short-circuit arm 14, the antenna performance will be improved.

As mentioned above, the circuit board 11 includes a first grounding point 130, a second grounding point 140 and a feeding point 141. The first grounding point 130 is connected with the grounding arm 13, and the second grounding point 140 and the feeding point 141 are both connected with the feeding short-circuit arm 14. The position of the grounding arm 13 which is connected with the first grounding point 130 can be flexibly designed, for example a middle portion of the grounding arm 13 or an end of the grounding arm 13. Similarly, the second grounding point 140 and the feeding point 141 can be connected with a middle portion of the feeding short-circuit arm 14, or can be connected with an end of the feeding short-circuit arm 14.

In order to further improve the antenna performance, the first grounding point 130 can be connected with an end of the grounding arm 13 and, at the same time, the second grounding point 140 and the feeding point 141 are both connected with an end of the feeding short-circuit arm 14. At this time, two ends of the grounding arm 13 can respectively be a first end and a second end, two ends of the feeding short-circuit arm 14 can respectively be a third end and a fourth end. The third end is closer to the first end rather than the fourth end, and the fourth end is closer to the second end rather than the third end. The first grounding point 130 can be connected with the first end of the grounding arm 13, and the second grounding point 140 and the feeding point 141 are both connected with the third end of the feeding short-circuit arm 14. That is, the second grounding point 140 and the feeding point 141 can both be connected with an end of the feeding short-circuit arm 14 close to the first grounding point 130, so as to significantly improve radiation performance of the antenna. Obviously, the first grounding point 130 can be connected with the second end of the grounding arm 13 and, at the same time, the second grounding point 140 and the feeding point 141 are both connected with the fourth end of the feeding short-circuit arm 14.

By adopting any one of the above embodiments, or any combination thereof, the antenna provided in embodiments of the present disclosure can cover a frequency range of 1550 MHZ-1650 MHZ, so that the radiation performance of the antenna is better.

Figure 4:
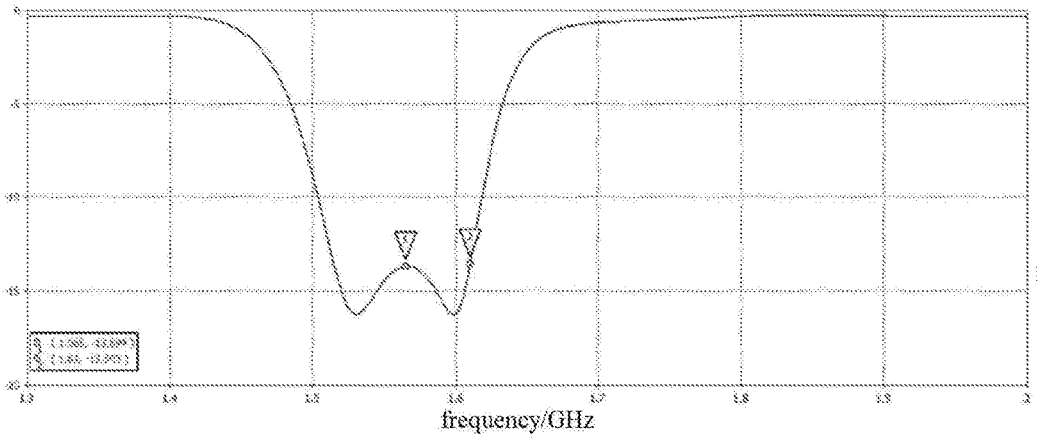
FIG. 4 is a graph showing return loss of an antenna in accordance with an exemplary embodiment of the present disclosure.
Figure 5:
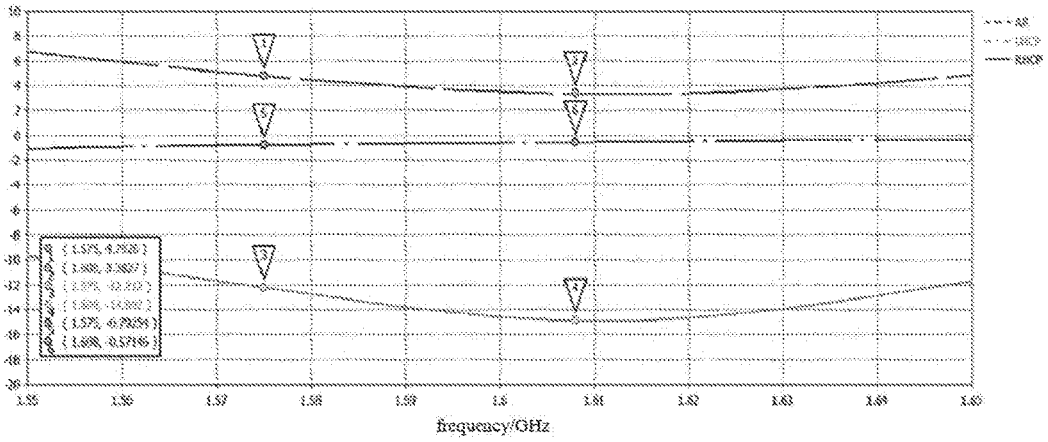
FIG. 5 is a graph showing right-handed gain (RHCP), left-handed gain (LHCP) and axial ratio (AR) of an antenna in accordance with an exemplary embodiment of the present disclosure.

FIG. 4 is a graph showing return loss of an antenna in accordance with an exemplary embodiment of the present disclosure, FIG. 5 is a graph showing right-handed gain (RHCP), left-handed gain (LHCP) and axial ratio (AR) of an antenna in accordance with an exemplary embodiment of the present disclosure. As shown in FIG. 4 and FIG. 5, the antenna provided by embodiments of the present disclosure can possess remarkable performance.

Based on the above structure, an exemplary embodiment of the present disclosure provides a wearable device, which can specifically be an electronic device such as a watch. The wearable device includes the antenna as described in any one of the above embodiments.

The above only shows preferred embodiments of the present disclosure, which are not used to limit the present disclosure. For those skilled in the art, the present disclosure can have many modifications and variations. Any modification, equivalent replacement and improvement made within the spirit and principle of the present disclosure shall be included in the protection scope of the present disclosure.

What is claimed is:

1. An antenna, comprising:

a circuit board, which is used as an antenna ground, comprising a first grounding point, a second grounding point and a feeding point;

a metal ring suspended with respect to the circuit board;

a grounding arm; and a feeding short-circuit arm;

wherein the metal ring, the grounding arm and the feeding short-circuit arm are spaced from each other, and the grounding arm is between the metal ring and the feeding short-circuit arm; the first grounding point is connected with the grounding arm, both the second grounding point and the feeding point are connected with the feeding short-circuit arm;

every two of the metal ring, the grounding arm and the feeding short-circuit arm are coupled to each other to form a ring current on the metal ring, so as to achieve circular polarization properties of the antenna;

the metal ring, the grounding arm and the feeding short-circuit arm are in a same plane parallel to the circuit board.

2. The antenna as described in claim 1, wherein the metal ring, the grounding arm and the feeding short-circuit arm are successively arranged in a direction from the metal ring toward the circuit board.

3. The antenna as described in claim 1, wherein the metal ring is a circular ring, both the grounding arm and the feeding short-circuit arm are circular arc arms, centers of circles in which the metal ring, the grounding arm and the feeding short-circuit arm are respectively located are located at a same normal line of the circuit board.

4. The antenna as described in claim 3, wherein a distance between the grounding arm and the feeding short-circuit arm in a radial direction of the metal ring is in a range of 0.4 mm-0.8 mm, and a distance between the grounding arm and the metal ring in the radial direction of the metal ring is in a range of 0.6 mm-1.2 mm.

5. The antenna as described in claim 1, wherein a circumferential length of the grounding arm is greater than or equal to a circumferential length of the feeding short-circuit arm.

6. The antenna as described in claim 1, wherein the first grounding point is connected with an end of the grounding arm, and both the second grounding point and the feeding point are connected with an end of the feeding short-circuit arm close to the first grounding point.

7. The antenna as described in claim 1, wherein a frequency range covered by the antenna is 1550 MHZ-1650 MHZ.

8. A wearable device, comprising the antenna as described in claim 1.

* * * * *